US011170692B1

(12) United States Patent
Orio et al.

(10) Patent No.: US 11,170,692 B1
(45) Date of Patent: Nov. 9, 2021

(54) DEVICE AND METHOD FOR CONTROLLING A DISPLAY PANEL

(71) Applicant: Synaptics Incorporated, San Jose, CA (US)

(72) Inventors: Masao Orio, Tokyo (JP); Takashi Nose, Kanagawa (JP); Hirobumi Furihata, Tokyo (JP); Akio Sugiyama, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/018,802

(22) Filed: Sep. 11, 2020

(51) Int. Cl.
*G09G 3/20* (2006.01)

(52) U.S. Cl.
CPC ..... *G09G 3/2022* (2013.01); *G09G 2310/027* (2013.01); *G09G 2320/0276* (2013.01); *G09G 2320/0673* (2013.01)

(58) Field of Classification Search
CPC ..... G09G 3/2022; G09G 2310/027; G09G 2320/0276; G09G 2320/0673
See application file for complete search history.

(56) References Cited

U.S. PATENT DOCUMENTS 8,107,007 B2 * 1/2012 Ogino ..... H04N 7/015 348/441
2007/0290964 A1 * 12/2007 Yang ..... G09G 3/3648 345/87
2010/0053222 A1 * 3/2010 Kerofsky ..... G09G 3/3406 345/690
2010/0214328 A1 * 8/2010 Hara ..... G09G 3/2025 345/690
2011/0001874 A1 * 1/2011 Ohta ..... H04N 7/0135 348/448
2011/0032419 A1 * 2/2011 Sakaniwa ..... H04N 7/014 348/452
2012/0162290 A1 * 6/2012 Shiomi ..... H04N 7/014 345/690
2014/0146098 A1 * 5/2014 Furihata ..... G09G 3/2092 345/694
2014/0375704 A1 * 12/2014 Bi ..... G09G 3/3233 345/694
2016/0063965 A1 * 3/2016 Yoo ..... G09G 3/3406 345/428
2018/0054594 A1 * 2/2018 Tsai ..... H04N 7/0127
2018/0075798 A1 * 3/2018 Nho ..... G09G 3/32
2018/0240440 A1 * 8/2018 Furihata ..... G09G 5/395
2019/0244576 A1 * 8/2019 Kwak ..... G09G 3/3655
2020/0193892 A1 * 6/2020 Berget ..... G09G 3/3607
2020/0279519 A1 * 9/2020 Orio ..... G09G 3/20

* cited by examiner

*Primary Examiner* — Joe H Cheng
(74) *Attorney, Agent, or Firm* — Ferguson Braswell Fraser Kubasta PC

(57) ABSTRACT

The display driver includes control circuitry and signal supply circuitry. The control circuitry is configured to store a first setting table for a first frame rate and a second setting table for a second frame rate. The control circuitry is further configured to, in response to adjusting a frame rate of a display device from the first frame rate to the second frame rate, generate an interpolated control parameter through interpolation of a first control parameter obtained from the first setting table and a second control parameter obtained from the second setting table. The signal supply circuitry is configured to generate at least one first signal to be supplied to a display panel based on the interpolated control parameter.

17 Claims, 8 Drawing Sheets

DEVICE AND METHOD FOR CONTROLLING A DISPLAY PANEL

FIELD

This disclosed technology generally relates to a device and method for controlling a display panel.

BACKGROUND

A display device may be configured such that the frame rate (also referred to as frame frequency) is adjustable. An increased frame rate improves the image quality, while a decreased frame rate reduces power consumption. In view of this, the frame rate may be controlled depending on the contents of display images (e.g., videos, still images, etc.) For example, the frame rate may be set to 60 Hz in a normal operation, and increased up to 90 Hz or more during gaming.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes control circuitry and signal supply circuitry. The control circuitry is configured to store a first setting table for a first frame rate and a second setting table for a second frame rate. The control circuitry is further configured to, in response to adjusting a frame rate of a display device from the first frame rate to the second frame rate, generate an interpolated control parameter through interpolation of a first control parameter obtained from the first setting table and a second control parameter obtained from the second setting table. The signal supply circuitry is configured to generate at least one first signal to be supplied to a display panel based on the interpolated control parameter.

In one or more embodiments, a display device is provided. The display device includes a display panel and a display driver. The display driver includes control circuitry and signal supply circuitry. The control circuitry is configured to store a first setting table for a first frame rate and a second setting table for a second frame rate. The control circuitry is further configured to, in response to adjusting a frame rate of a display device from the first frame rate to the second frame rate, generate an interpolated control parameter through interpolation of a first control parameter obtained from the first setting table and a second control parameter obtained from the second setting table. The signal supply circuitry is configured to generate at least one first signal to be supplied to a display panel based on the interpolated control parameter.

In one or more embodiments, a method for controlling a display panel is provided. The method includes storing a first setting table for a first frame rate and a second setting table for a second frame rate. The method further includes determining, in response to adjusting a frame rate of a display device from the first frame rate to the second frame rate, an interpolated control parameter through interpolation of a first control parameter obtained from the first setting table and a second control parameter obtained from the second setting table. The method further includes generating at least one first signal to be supplied to a display panel based on the interpolated control parameter.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
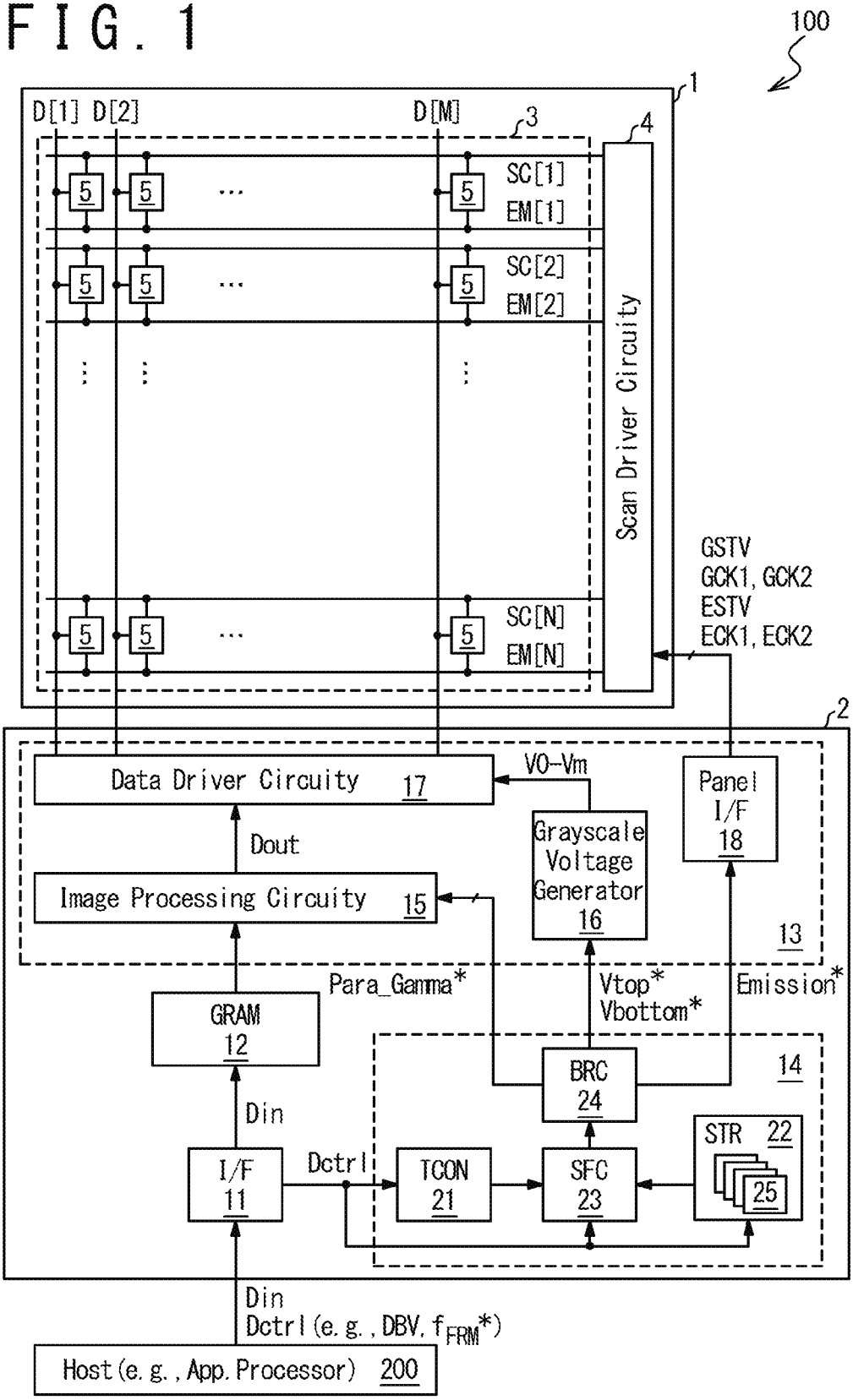
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. Suffixes may be attached to reference numerals for distinguishing identical elements from each other. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Variable frame rate (or variable frame frequency) is one approach to provide an improved image quality with a reduced power consumption. In one implementation, moving pictures (e.g., during gaming) may be displayed with an increased frame rate (e.g., 90 Hz or more) to improve the image quality. Still images or low frame rate videos, which are insensitive to a decrease in the frame rate, may be displayed with a reduced frame rate (e.g., 60 Hz or less) to decrease power consumption.

Changing the frame rate may cause a change in the display characteristics of the display device. In one implementation, a change in the frame rate may cause a change in the gamma characteristics (or the input-output property) of the display device and/or a change in the display brightness level (e.g., the brightness level of the entire displayed image). The change in the display characteristics may be visually perceivable, for example, in the form of undesired flickering of the displayed image.

This disclosure offers various technologies to mitigate an undesired effect of a change in the display characteristics potentially caused by a change in the frame rate. In one or more embodiments, a display driver includes control circuitry and signal supply circuitry. The control circuitry is configured to store a first setting table for a first frame rate and a second setting table for a second frame rate. The control circuitry is further configured to, in response to adjusting a frame rate of a display device from the first frame rate to the second frame rate, generate an interpolated control parameter through interpolation of a first control parameter obtained from the first setting table and a second control parameter obtained from the second setting table. The signal supply circuitry is configured to generate at least one first signal to be supplied to a display panel based on the interpolated control parameter. The use of the interpolated control parameter may suppress an effect of the change in the display characteristics, improving the image quality.

In one implementation, the first control parameter may be used to define a first gamma curve for the first frame rate, and the second control parameter may be used to define a second gamma curve for the second frame rate. In such implementations, the interpolation may offer a smooth change in the gamma curve, mitigating an undesired effect (e.g., flicker) potentially caused by a sudden change in the gamma curve.

FIG. 1 illustrates an example configuration of a display device 100, according to one or more embodiments. In the illustrated embodiment, the display device 100 is configured to display an image corresponding to input image data Din received from a host 200. Examples of the host 200 may include an application processor, a central processing unit (CPU), or other processors. The display device 100 includes a display panel 1 and a display driver 2. The display panel 1 may include a self-luminous display panel, such as an organic light emitting diode (OLED) display panel and a micro light emitting diode (LED) display panel. In other embodiments, the display panel 1 may be a liquid crystal display panel or a different type of display panel. In the illustrated embodiment, the display panel 1 includes a display area 3 and scan driver circuitry 4. The display area 3 includes pixel circuits 5, N gate scan lines SC [1] to SC [N], N emission lines EM [1] to EM [N], and M data lines D [1] to D [M]. The gate scan lines SC [1] to SC [N] and the N emission lines EM [1] to EM [N] are coupled to the scan driver circuitry 4 and the data lines D [1] to D [M] are coupled to the display driver 2. The gate scan lines SC [1] to SC [N] and the emission lines EM [1] to EM [N] are extended in the horizontal direction of the display panel 1, and the data lines D [1] to D [M] are extended in the vertical direction. Each pixel circuit 5 is coupled to a corresponding gate scan line SC, emission line EM, and data line D.

The pixel circuits 5 are each configured to be programmed or updated with a gamma voltage received from the display driver 2. In one or more embodiments, programming or updating a pixel circuit 5 connected to the gate scan line SC [i], the emission line EM [i], and the data line D [j] may be achieved by asserting the gate scan line SC [i] in a state in which the emission line EM [i] is deasserted and the gamma voltage is supplied to the data line D [j]. The pixel circuits 5 are each further configured to emit light with a luminance level corresponding to the gamma voltage. The light emission from the pixel circuits 5 is controlled by the emission lines EM [1] to EM [N]. The pixel circuits 5 connected to the emission line EM [i] are configured to emit light when the emission line EM [i] is asserted, not emitting light when deasserted.

The scan driver circuitry 4 is configured to select pixel circuits 5 to be programmed or updated by the gate scan lines SC [1] to SC [N] and the emission lines EM [1] to EM [N]. The scan driver circuitry 4 is configured to assert the gate scan line SC [i] while deasserting the emission line EM [i] when pixel circuits 5 connected to the gate scan line SC [i] and the emission line EM [i] are programmed or updated. The scan driver circuitry 4 is configured to sequentially assert the gate scan lines SC to program or update the pixel circuits 5 of the display area 3. The assertion and deassertion of the gate scan lines SC [1] to SC [N] may be controlled based on a gate scan control signal GSTV in synchronization with a pair of gate clocks GCK1 and GCK2, where the gate scan control signal GSTV and the gate clocks GCK1 and GCK2 are received from the display driver 2.

The scan driver circuitry 4 is further configured to control light emission from the pixel circuits 5 by the emission lines EM [1] to EM [N]. In displaying an image, selected ones of the emission lines EM [1] to EM [N] are asserted to allow the pixel circuits 5 connected thereto to emit light, and the selection of the asserted emission lines EM is successively shifted over the array of the emission lines EM in synchronization with emission clocks ECK1 and ECK2 received from the display driver 2. The assertion and deassertion of the emission lines EM [1] to EM [N] are controlled based on an emission control signal ESTV received from the display driver 2.

In one or more embodiments, the emission control signal ESTV is generated as a pulse-width modulated (PWM) signal and the display brightness level of the display device 100 is controlled by the duty ratio of the emission control signal ESTV. The display brightness level may be the brightness level of an entire image that is being displayed on the display panel 1. The duty ratio of the emission control signal ESTV may correspond to the ratio of a period during which the emission control signal ESTV is asserted to one cycle period of the emission control signal ESTV. In one or more embodiments, when the duty ratio of the emission control signal ESTV increases, the ratio of the number of asserted emission lines EM to the total number of the emission lines EM increases, and the ratio of the pixel circuits 5 that emit light to the total number of pixel circuits 5 also increases, resulting in an increase in the display brightness level of the display device 100.

In one or more embodiments, the display driver 2 is configured to control the display panel 1 based on input image data Din and control data Dctrl received from the host 200 to display an image corresponding to the input image data Din on the display panel 1. The input image data Din may include grayscale values associated with the pixel circuits 5 of the display panel 1. The control data may include a display brightness value (DBV) and a frame rate command $f_{FRM}$*. The DBV may specify a desired display brightness level of the display device 100. The frame rate command $f_{FRMA}$* may specify a desired frame rate of the display device 100. In the illustrated embodiment, the display driver 2 includes interface (I/F) circuitry 11, a graphic random-access memory (GRAM) 12, signal supply circuitry 13, and control circuitry 14.

In one or more embodiments, the interface circuitry 11 is configured to receive the input image data Din and the control data Dctrl from the host 200. The interface circuitry 11 may be further configured to forward the input image data Din to the GRAM 12 and forward the control data Dctrl to the control circuitry 14. In other embodiments, the interface circuitry 11 may be configured to process the input image data Din and send the processed input image data Din to the GRAM 12.

The GRAM 12 is configured to temporarily store the input image data Din received from the interface circuitry 11 and forward the input image data Din to the signal supply circuitry 13. In other embodiments, the GRAM 12 may be omitted and the input image data Din may be directly transferred from the interface circuitry 11 to the signal supply circuitry 13.

The signal supply circuitry 13 is configured to supply various signals to the display panel 1 under control of the control circuitry 14. The signals supplied to the display panel 1 may include the gamma voltages with which the pixel circuits 5 are programmed or updated, the gate scan control signal GSTV, the gate clocks GCK1, GCK2, the emission control signal ESTV, the emission clocks ECK1, and ECK2. The signal supply circuitry 13 may include image processing circuitry 15, grayscale voltage generator 16, data driver circuitry 17, and panel interface (I/F) circuitry 18.

In one or more embodiments, the image processing circuitry 15 is configured to process the input image data Din received from the GRAM 12 to generate output voltage data Dout. The output voltage data Dout may include voltage values that specify voltage levels of the gamma voltages with which the respective pixel circuits 5 of the display panel 1 are to be programmed or updated.

The processing performed by the image processing circuitry 15 includes a gamma transformation to convert grayscale values to voltage values. The gamma transformation may be controlled based on a set of gamma parameters Para_Gamma received from the control circuitry 14, where the gamma parameters Para_Gamma define a gamma curve in accordance with which the gamma transformation is performed. The gamma curve represents the correlation between grayscale values and voltage values. The processing performed by the image processing circuitry 15 may further include one or more other processes (e.g., color adjustment, image scaling, etc.), which may be implemented before and/or after the gamma transformation.

The grayscale voltage generator 16 is configured to supply (m+1) grayscale voltages V0 to Vm to the data driver circuitry 17. In various embodiments, the (m+1) grayscale voltages V0 to Vm have different voltage levels from each other. In embodiments where the grayscale voltage V0 is the highest grayscale voltage and the grayscale voltage Vm is the lowest grayscale voltage, the grayscale voltage generator 16 may be configured to generate the highest grayscale voltage V0 and the lowest grayscale voltage Vm and further generate the intermediate grayscale voltages V1 to V(m−1) through voltage dividing of the grayscale voltages V0 and Vm. In such embodiments, the highest grayscale voltage V0 and the lowest grayscale voltage Vm may control the display brightness level since the display brightness level of the display device 100 depends on the range of the gamma voltages supplied to the pixel circuits 5.

The voltage level of the highest grayscale voltage V0 may be specified by a top voltage command value Vtop* received from the control circuitry 14, and the voltage level of the lowest grayscale voltage Vm may be specified by a bottom voltage command value Vbottom*. In such embodiments, the range of the gamma voltages, that is, the display brightness level of the display device 100 may be controlled based at least in part on the top voltage command value Vtop* and the bottom voltage command value Vbottom*.

The data driver circuitry 17 is configured to generate gamma voltages to be provided to the respective pixel circuits 5 of the display panel 1 based on the output voltage data Dout received from the image processing circuitry 15 and the grayscale voltages V0-Vm received from the grayscale voltage generator 16. The data driver circuitry 17 may be configured to select the grayscale voltages V0 to Vm based on the voltage values of the output voltage data Dout for the respective pixel circuits 5 and output the selected grayscale voltages as the gamma voltages to be supplied to the respective pixel circuits 5. In one implementation, the gamma voltage to be supplied to each pixel circuit 5 ranges from Vm to V0 and increases as the corresponding voltage value of the output voltage data Dout increases.

The panel interface circuitry 18 is configured to generate the gate scan control signal GSTV, the gate clocks GCK1, GCK2, the emission control signal ESTV, and the emission clocks ECK1 and ECK2 to control the scan driver circuitry 4 of the display panel 1. In one or more embodiments, the panel interface circuitry 18 is configured to control the duty ratio of the emission control signal ESTV based on an emission command Emission* received from the control circuitry 14. The emission command Emission* may specify a desired duty ratio of the emission control signal ESTV. In embodiments where the display brightness level of the display device 100 is controllable with the emission control signal ESTV, the display brightness level is controllable with the emission command Emission*.

In one or more embodiments, the control circuitry 14 is configured to control the operation of the signal supply circuitry 13 based on the control data Dctrl received from the host 200 via the interface circuitry 11. In embodiments where the control data Dctrl includes a display brightness value (DBV), the control circuitry 14 may be configured to control the display brightness level of the display device 100 based on the DBV. The DBV may be generated based on a user operation. For example, when an instruction to adjust the brightness of an image displayed on the display device 100 is manually input to an input device (not illustrated), the host 200 may generate the DBV based on this instruction to adjust the display brightness level. The input device may include a touch panel disposed on at least a portion of the display panel 1, a cursor control device, and mechanical and/or non-mechanical buttons.

The control circuitry 14 may be further configured to control the frame rate (or frame frequency) of the display device 100. In embodiments where the control data Dctrl includes the frame rate command $f_{FRM}$*, the control circuitry 14 may be configured to control the frame rate as specified by the frame rate command $f_{FRM}$*. In one or more embodiments, the control circuitry 14 includes a timing controller (TCON) 21, storage (STR) circuitry 22, a seamless frame rate controller (SFC) 23, and a brightness controller (BRC) 24.

The timing controller 21 is configured to control operation timing of the display device 100 based on the control data Dctrl. The operation timing control may include specifying the frame rate of the display device 100. In some embodiments, the timing controller 21 may be configured to specify the frame rate as that specified by the frame rate command $f_{FRM}$*. In embodiments where the timing controller 21 fails to receive the frame rate command $f_{FRM}$*, the timing controller 21 may be configured to specify the frame rate by itself.

The timing controller 21 may be further configured to generate a vertical sync period to achieve the frame rate thus specified. The vertical sync signal may define frame periods (or vertical sync periods) by being asserted at the beginning of each frame period (or each vertical sync period). The signal supply circuitry 13 may be configured to operate in synchronization with the vertical sync signal. In one implementation, the vertical sync period may be generated such that each frame period has a time duration of the inverse number of the specified frame rate.

The storage circuitry 22 is configured to store a plurality of setting tables 25 each including information to control the signal supply circuitry 13. The plurality of setting tables 25 are associated with (or defined for) a plurality of predetermined frame rates, respectively. Each setting table 25 may include control parameters that control the signal supply circuitry 13. The term table refers to any storage mechanism that relates sets of values. The group of setting tables may be a single storage structure or multiple structures. Each setting table is defined for a corresponding frame rate, and relates the control parameters to DBVs. In one implementation, the control parameters contained in each setting table 25 may include a set of gamma parameters Para_Gamma, an emission command value Emission*, a top voltage command value Vtop* and/or a bottom voltage command value Vbottom*.

Figure 2:
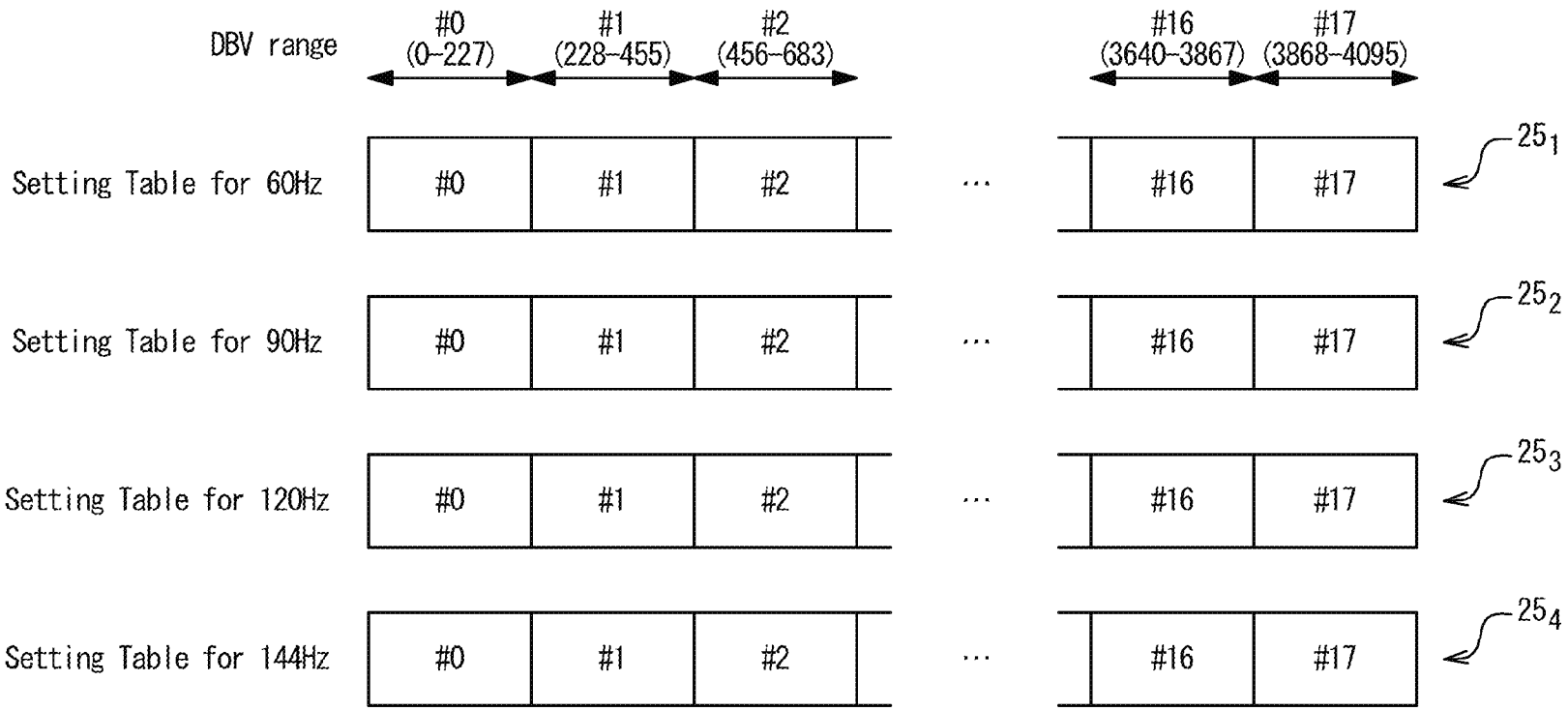
FIG. 2 illustrates example setting tables stored in storage circuitry, according to one or more embodiments.

FIG. 2 illustrates example setting tables 25 stored in the storage circuitry 22, according to one or more embodiments. In the illustrated embodiment, the setting tables 25 stored in the storage circuitry 22 include four setting tables $\mathbf{25}_1$, $\mathbf{25}_2$, $\mathbf{25}_3$, and $\mathbf{25}_4$ defined for frame rates of 60, 90, 120, and 144 Hz, respectively. These setting tables $\mathbf{25}_1$, $\mathbf{25}_2$, $\mathbf{25}_3$, and $\mathbf{25}_4$ may be collectively denoted by the numeral 25. The setting tables 25 may be defined for different frame rates. The number of the setting tables 25 stored in the storage circuitry 22 is not limited to four. In some embodiments, only two or three setting tables 25 may be stored in the storage circuitry 22. In other embodiments, five or more setting tables 25 may be stored in the storage circuitry 22.

Each of the setting tables $\mathbf{25}_1$ to $\mathbf{25}_4$ includes a plurality of subtables associated with different DBV ranges. In the illustrated embodiment, each of the setting tables $\mathbf{25}_1$ to $\mathbf{25}_4$ includes 18 subtables #0 to #17 associated with DBV ranges #0 to #17, respectively. In embodiments where the DBV is defined as a 12-bit value from 0 to 4095, DBV ranges #0 to #17 are defined to cover the range from 0 to 4095. In the illustrated embodiment, DBV range #0 is defined as a range between 0 to 227, inclusive, and DBV range #1 is defined as a range between 228 to 455, inclusive. Other DBV ranges may be defined similarly. Subtable #i includes one or more control parameters for DBV range #i, where i is an integer from 0 to 17. The control parameters of each subtable #i may include a set of gamma parameters Para_Gamma, an emission command value Emission*, a top voltage command value Vtop* and/or a bottom voltage command value Vbottom* for DBV range #i.

The storage circuitry 22 may be further configured to store one or more setting tables defined for one or more different frame rates, each setting table including a plurality of subtables associated with the plurality of DBV ranges.

Referring back to FIG. 1, the SFC 23 is configured to forward to the BRC 24 a first subtable selected from a first setting table (e.g., the setting table $\mathbf{25}_1$ for 60 Hz illustrated in FIG. 2) of the plurality of setting tables stored in the storage circuitry 22 and a second subtable selected from a second setting table (e.g., the setting table $\mathbf{25}_2$ for 90 Hz) of the plurality of setting tables. In embodiments where the storage circuitry 22 is configured to store three or more setting tables, the first and second setting tables may be selected based on the frame rate specified as described above such that the specified frame rate is between the frame rates corresponding to the first and second setting tables. The selection of the first subtable from the first setting table and the selection of the second subtable from the second setting table may be based on the DBV. In embodiments where the setting tables $\mathbf{25}_1$ to $\mathbf{25}_4$ are stored in the storage circuitry 22 as illustrated in FIG. 2, subtables #i of the first and second setting tables selected from the setting tables $\mathbf{25}_1$ to $\mathbf{25}_4$ may be selected as the first and second subtables and forwarded to the BRC 24 when the DBV is in DBV range #i.

The SFC 23 is further configured to determine (e.g., calculate) one or more interpolation coefficients used to interpolate the control parameters contained in the first subtable and the second subtable based on the frame rate specified as described above. The determined interpolation coefficients may include one or more interpolation coefficients for the gamma parameters Para_Gamma, the top voltage command value Vtop*, the bottom voltage command value Vbottom*, and/or the emission command value Emission*.

The BRC 24 is configured to generate control parameters used to control the signal supply circuitry 13 by interpolating the control parameters contained in the first and second subtables selected by the SFC 23 based on the interpolation coefficients determined by the SFC 23. The BRC 24 may be configured to generate the gamma parameters Para_Gamma to be used by the image processing circuitry 15 by interpolating those contained in the first and second subtables based on the interpolation coefficient determined for the gamma parameters Para_Gamma. The BRC 24 may be further configured to generate the emission command value Emission* to be used by the panel interface circuitry 18 by interpolating those contained in the first and second subtables based on the interpolation coefficients determined for the emission command value Emission*. The BRC 24 may be further configured to generate the top voltage command value Vtop* and the bottom voltage command value Vbottom* to be used by the grayscale voltage generator 16 by interpolating those contained in the first and second subtables based on the interpolation coefficients determined for the top voltage command value Vtop* and the bottom voltage command value Vbottom*, respectively.

The control parameters thus generated are provided to the signal supply circuitry 13 to control the operation of the signal supply circuitry 13. The image processing circuitry 15 of the signal supply circuitry 13 may be configured to process the input image data Din based on the gamma parameters Para_Gamma thus generated to generate the output voltage data Dout. The panel interface circuitry 18 may be configured to generate the emission control signal ESTV based on the emission control value Emission* thus generated. The grayscale voltage generator 16 may be configured to generate the highest grayscale voltage V0 based on the top voltage command value Vtop* and the lowest grayscale voltage Vm based on the bottom voltage command value Vbottom* and generate the grayscale voltages V0 to Vm through voltage dividing of the grayscale voltages V0 and Vm.

Figure 3:
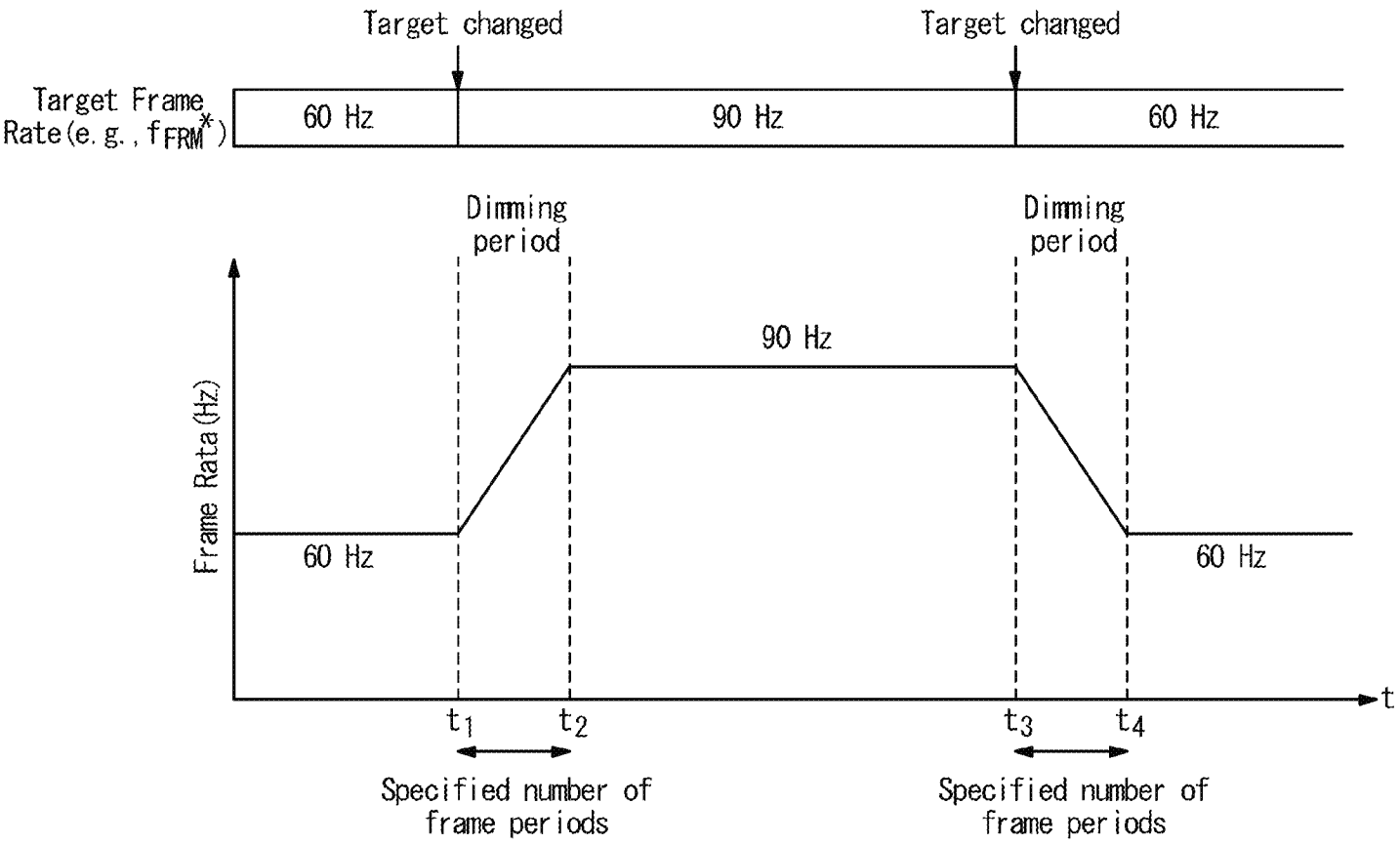
FIG. 3 illustrates an example frame rate control, according to one or more embodiments.

FIG. 3 illustrates an example frame rate control, according to one or more embodiments. In the illustrated embodiment, a target frame rate is specified by the host 200 or the timing controller 21, and the frame rate of the display device 100 is adjusted to follow the target frame rate. In one embodiment, the target frame rate is specified by the frame rate command $f_{FRM}$* received from the host 200. In other embodiments, the target frame rate may be specified by the timing controller 21 instead. In the illustrated embodiment, the target frame rate is initially set to 60 Hz, which is the frame rate for a normal operation, and the frame rate of the display device 100 is set to 60 Hz during frame periods before time $t_1$.

At time $t_1$, the target frame rate is changed to 90 Hz. In one implementation, this change may aim at improving the image quality during gaming or displaying videos. In response to the change of the target frame rate, the frame rate of the display device 100 is gradually increased toward 90 Hz during a first dimming period starting from time $t_1$. The first diming period may include a specified number of frame periods, e.g., several ten to several thousand frame periods. The timing controller 21 specifies the frame rate in each frame period during the first dimming period such that the specified frame rate gradually increases. At time $t_2$, the specified frame rate reaches 90 Hz. This is followed by maintaining the frame rate at 90 Hz during frame periods between time $t_2$ and time $t_3$.

At time $t_3$, the target frame rate is changed to 60 Hz. In response to the change of the target frame rate, the frame rate of the display device 100 is gradually decreased toward 60 Hz during a second dimming period starting from time $t_3$. The second diming period may include a specified number of frame periods, e.g., several ten to several thousand frame periods. The timing controller 21 specifies the frame rate in each frame period during the second dimming period such that the specified frame rate gradually decreases. At time $t_4$, the frame rate reaches 60 Hz. This is followed by maintaining the frame rate at 60 Hz thereafter.

In other embodiments, the frame rate command $f_{FRM}$* may directly specify the frame rate in each frame period during the first and second dimming periods between $t_1$ and $t_2$ and between $t_3$ and $t_4$. In still other embodiments, the timing controller 21 may specify the frame rate in each frame period during the first and second dimming periods independently of the frame rate command $f_{FRM}$*.

Figure 4:
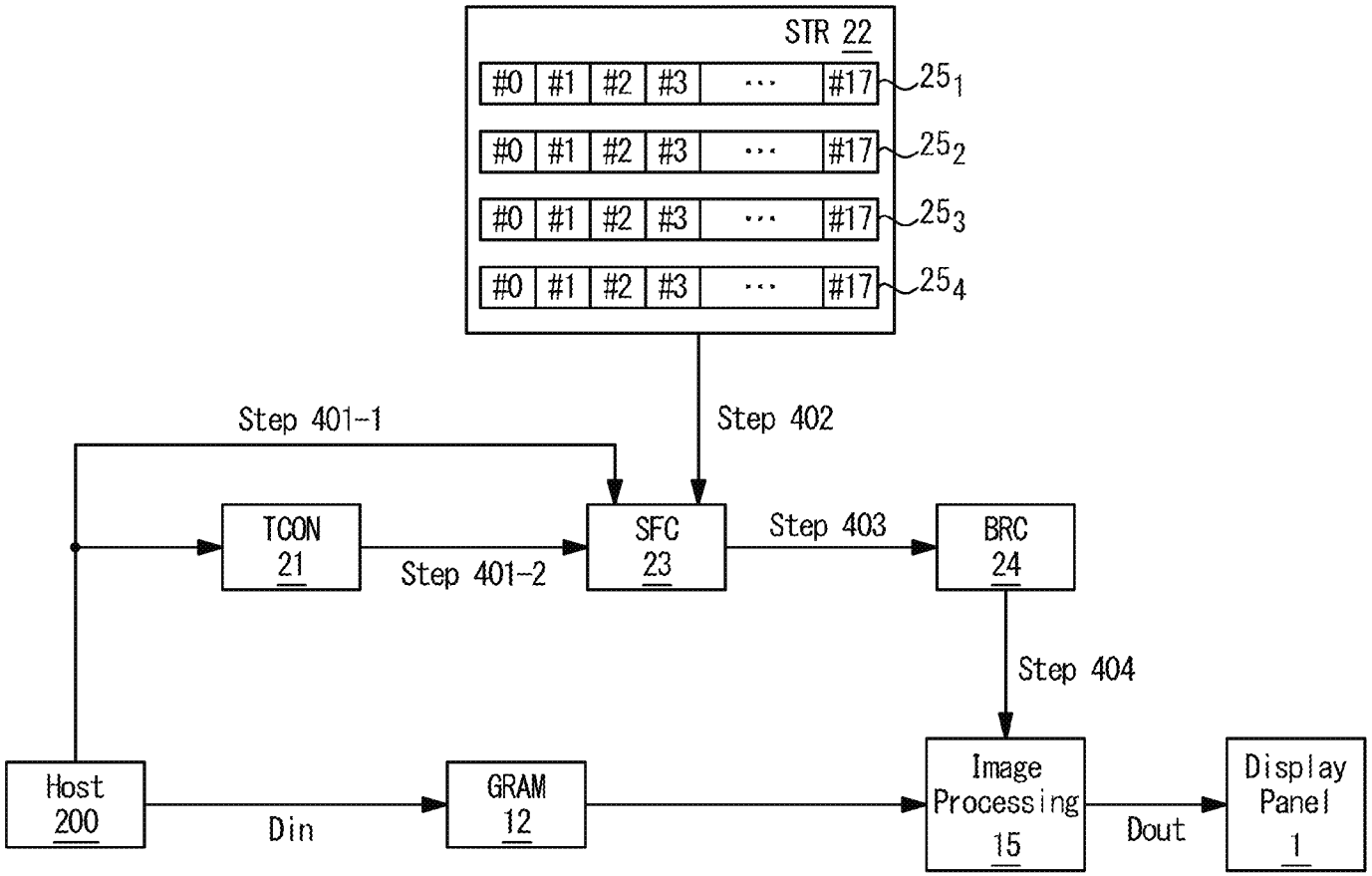
FIG. 4 illustrates an example control of the image processing, according to one or more embodiments.

FIG. 4 illustrates an example control of the image processing (e.g., the gamma transformation) in embodiments where the frame rate is variably adjusted (e.g., as illustrated in FIG. 3), according to one or more embodiments. In some embodiments, the host 200 specifies the frame rate for the current frame period at step 401-1. In other embodiments, the timing controller 21 alternatively specifies the frame rate for the current frame period at step 401-2. The frame rate for the current frame period may be specified based on the target frame rate specified by the host 200 (e.g., in the form of the frame rate command $f_{FRM}$*) as described in relation to FIG. 3.

At step 402, the SFC 23 obtains control parameters (e.g., gamma parameters) from two of the setting tables 25 stored in the storage circuitry 22 based on the specified frame rate and/or the DBV. In one implementation, the SFC 23 selects two of the setting tables 25 based on the specified frame rate for the current frame period and further selects a subtable from each of the selected two setting tables 25 based on the DBV. In one implementation, the SFC 23 selects subtable #i from each of the selected two setting tables 25 when the DBV is in the DBV range #i. In such embodiments, the SFC 23 obtains the controller parameters from each subtable #i of the selected two setting tables 25. In embodiments where the storage circuitry 22 stores only two setting tables 25, the SFC 23 may obtain the controller parameters from each subtable #i of the two setting tables 25.

At step 403, the SFC 23 determines one or more interpolation coefficients based on the frame rate specified for the current frame rate. At step S404, the BRC 24 generates control parameters to be used by the image processing circuitry 15 by interpolating the control parameters obtained from the two selected setting tables 25 (e.g., from subtables #i of the two selected setting tables 25) based on the interpolation coefficients. The image processing circuitry 15 processes the input image data based on the control parameters generated by the BRC 24.

Figure 5:
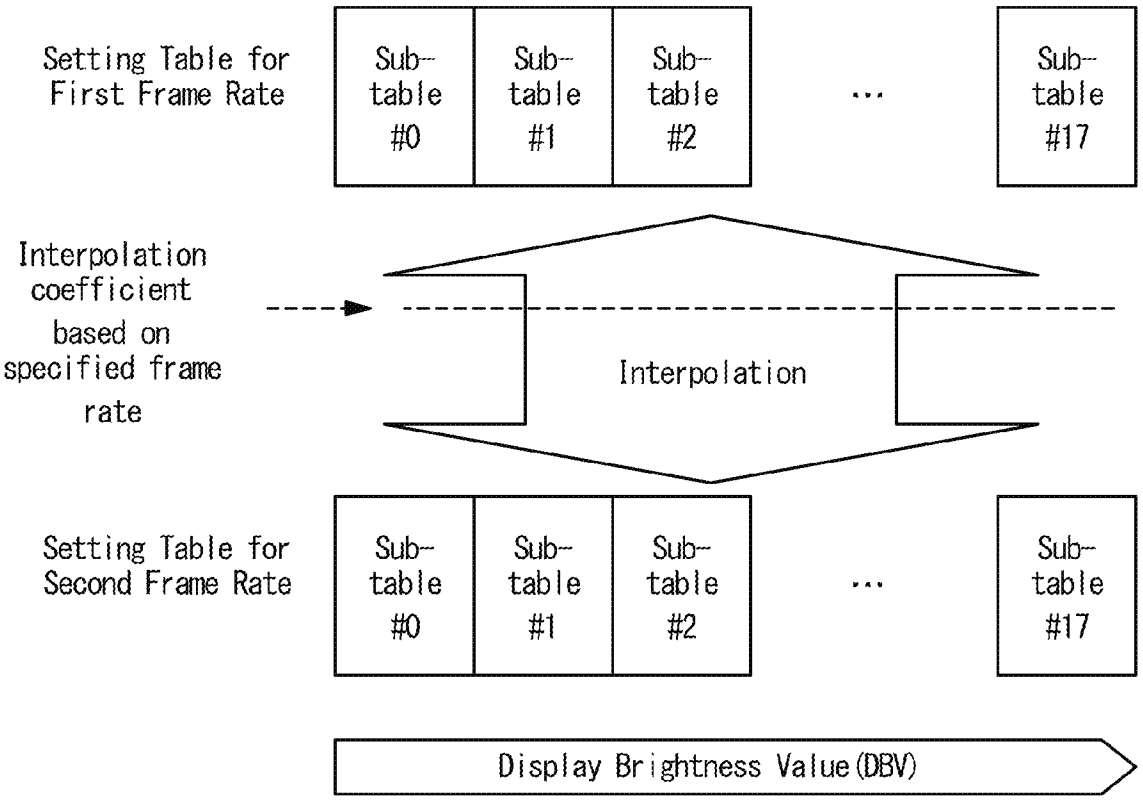
FIG. 5 illustrates example generation of a gamma curve through interpolation, according to one or more embodiments.
Figure 6:
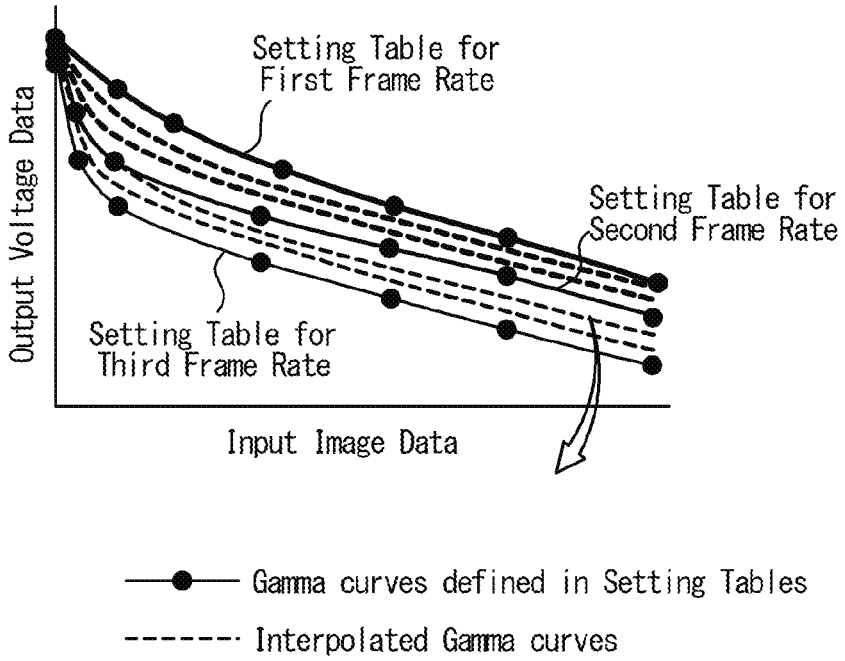
FIG. 6 illustrates example changes in the gamma curve used for the gamma transformation, according to one or more embodiments.

In one implementation, the control parameters generated by the BRC 24 include a set of gamma parameters Para_Gamma used to generate or determine a gamma curve in accordance with which the image processing circuitry 15 performs a gamma transformation. FIGS. 5 and 6 illustrates example generation of the gamma curve through the interpolation described in relation to FIG. 4.

In the embodiment illustrated in FIG. 5, a setting table 25 for a first frame rate (e.g., the setting table $\mathbf{25}_1$ for 60 Hz) and the setting table 25 for a second frame rate (e.g., the setting table $\mathbf{25}_2$ for 90 Hz) are selected in response to the frame rate being specified between the first frame rate (e.g., 60 Hz) and the second frame rate (e.g., 90 Hz) for the current frame period.

In one implementation, the gamma parameters Para_Gamma used for the gamma transformation in the image processing circuitry 15 are generated through interpolation of the corresponding gamma parameters contained in subtables #i of the setting tables $\mathbf{25}_1$ and $\mathbf{25}_2$ when the DBV is in DBV range #i. The interpolation coefficient used for this interpolation is determined based on the frame rate specified for the current frame period. In embodiments where the interpolation coefficient for the first frame rate (e.g., 60 Hz) is a first value (e.g., 0), and the interpolation coefficient for the second frame rate (e.g., 90 Hz) is a second value (e.g., 255), the interpolation coefficient for the specified frame rate may be determined as a value between the first value and the second value, when the specified frame rate is between the first frame rate and the second frame rate. The interpolation coefficient may be determined depending on the difference between the specified frame rate and the first frame rate divided by the difference between the second frame rate and the specified frame rate. In embodiments where the interpolation coefficient is determined as a value between 0 and 255, inclusive, the interpolation coefficient Coef_int may be determined as follows:

$$\text{Coef_int} = \frac{f - f_1}{f_2 - f_1} \cdot 255,$$

where f is the specified frame rate; $f_1$ is the first frame rate; and $f_2$ is the second frame rate.

In one implementation, the gamma parameters Para_Gamma used for the gamma transformation may be determined as weighted sums of the corresponding gamma parameters contained in subtables #i of the setting tables 25 for the first and second frame rates, the weighting factors being dependent on the interpolation coefficient. In embodiments where the interpolation coefficient is determined as the value between 0 and 255, inclusive, as discussed above, each gamma parameter Para_Gamma [k] may be determined in accordance with the following expression:

$$\text{Para_Gamma}[k]=w_1\cdot\text{Para_Gamma}_1[k]+w_2\cdot\text{Para_Gamma}_2[k],$$

where $\text{Para_Gamma}_1$ [k] is the corresponding gamma parameter contained in the selected subtable #i of the setting table 25 corresponding to the first frame rate; $\text{Para_Gamma}_2$ [k] is the corresponding gamma parameter contained in the selected subtable #i of the setting table 25 corresponding to the second frame rate; and the weighting factors $w_1$ and $w_2$ are determined as follows:

$$w_1=1-\text{Coef_int}/255, \text{ and}$$

$$w_2=\text{Coef_int}/255.$$

Figure 7:
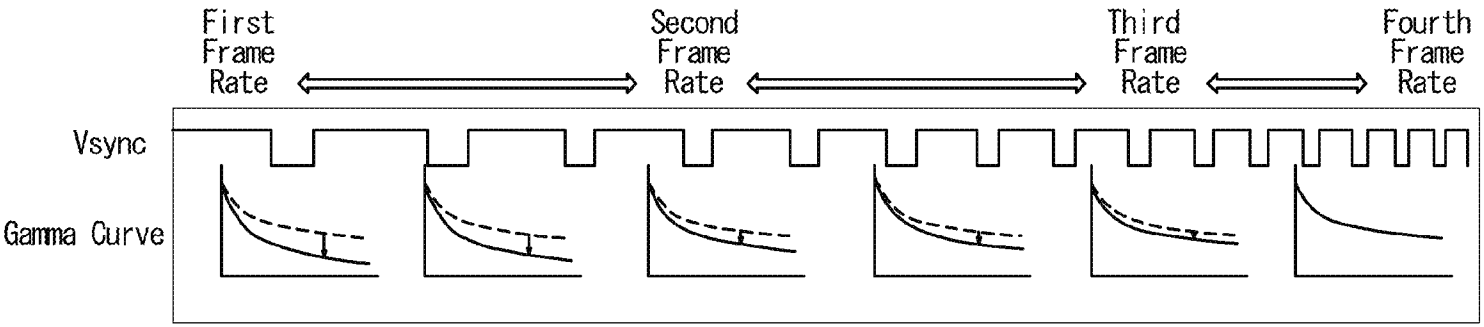
FIG. 7 schematically illustrates an example waveform of the vertical sync signal and example changes in the gamma curve, according to one or more embodiments.

FIG. 6 illustrate example changes in the gamma curve used for the gamma transformation in the image processing circuitry 15. In FIG. 6, the solid lines and dots indicate the gamma curves defined by the gamma parameters contained in the setting tables 25 for first, second and third frame rates (e.g., 60, 90, and 120 Hz.) The above-described interpolation-based scheme allows the gamma curve to smoothly (or seamlessly) change as the frame rate is gradually changed (e.g., from the first frame rate to the third frame rate) This may effectively suppress an undesired effect (e.g., flicker) that is potentially caused by the change in the frame rate. FIG. 7 schematically illustrates an example waveform of the vertical sync signal Vsync and example changes in the gamma curve. The gamma curve is smoothly changed or modified while the frame rate is increased by reducing the periodicity of the vertical sync signal (i.e., the length of the frame period).

In some embodiments, the top voltage command value Vtop* and/or the bottom voltage command value Vbottom* may be generated through interpolation in a similar manner in addition to or in place of the gamma parameters Para_Gamma. In such embodiments, the control parameters contained in the subtables (e.g., subtables #0 to #17 in FIG. 2) of each setting table 25 may include a top voltage command value and/or a bottom voltage command value for the frame rate corresponding to the setting table 25.

Referring back to FIG. 1, the SFC 23 may be configured to obtain the top voltage command values and/or the bottom voltage command values from two of the setting tables 25 stored in the storage circuitry 22 based on the specified frame rate and/or the DBV. The SFC 23 may be configured to select two of the setting tables 25 based on the specified frame rate for the current frame period and further select subtable #i from each of the selected two setting tables 25 when the DBV is in the DBV range #i. In such embodiments, the SFC 23 may be configured to obtain the top voltage command value and/or the bottom voltage command value from each subtable #i of the selected two setting tables 25. The SFC 23 may be further configured to determine an interpolation coefficient based on the frame rate specified for the current frame rate.

The BRC 24 may be configured to generate the top voltage command value Vtop* and/or the bottom voltage command value Vbottom* to be used by the grayscale voltage generator 16 by interpolating the top voltage command values and/or the bottom voltage command values obtained from the two selected setting tables 25 (e.g., from subtables #i of the two selected setting tables 25) based on the interpolation coefficient. The grayscale voltage generator 16 may be configured to generate the highest grayscale voltage V0 as indicated by the top voltage command value Vtop* and generate the lowest grayscale voltage Vm as indicated by the bottom voltage command value Vbottom*. The generation of the top voltage command value Vtop* and/or the bottom voltage command value Vbottom* through the interpolation may enable smoothly (or seamlessly) changing the range of the gamma voltages provided to the pixel circuits 5. This may effectively suppress undesired image quality degradation (e.g., flicker) potentially caused the change in the frame rate.

In other embodiments, the emission command value Emission* may be generated through interpolation in a similar manner in addition to or in place of the gamma parameters Para_Gamma, the top voltage command value Vtop*, and/or the bottom voltage command value Vbottom*. It should be noted that the emission command value specifies the duty ratio of the emission control signal ESTV to control the ratio of pixels circuits 5 that emit light to the total number of the pixel circuits 5 in the display panel 1 as described above in relation to FIG. 1. In such embodiments, the control parameters contained in each subtable (e.g., subtables #0 to #17 in FIG. 2) of each setting table 25 may include an emission command value for the frame rate corresponding to the setting table 25.

In one implementation, the SFC 23 may be configured to obtain the emission command values from two of the setting tables 25 stored in the storage circuitry 22 based on the specified frame rate and/or the DBV. The SFC 23 may be configured to select two of the setting tables 25 based on the specified frame rate for the current frame period and further select subtable #i from each of the selected two setting tables 25 when the DBV is in the DBV range #i. In such embodiments, the SFC 23 may be configured to obtain the emission command value from each subtable #i of the selected two setting tables 25. The SFC 23 may be further configured to determine an interpolation coefficient based on the frame rate specified for the current frame rate.

The BRC 24 may be configured to generate the emission command value Emission* to be used by the panel interface circuitry 18 by interpolating the emission command values obtained from the two selected setting tables 25 (e.g., from subtables #i of the two selected setting tables 25) based on the interpolation coefficient. The panel interface circuitry 18 may be configured to generate the emission control signal ESTV with the duty ratio indicated by the emission command value Emission*. The generation of the emission command value Emission* through the interpolation may enable smoothly (or seamlessly) changing the duty ratio of the emission control signal ESTV, which controls the display brightness level of the display device 100 through controlling the ratio of the number of pixel circuits 5 that emit light to the total number of the pixel circuits 5. This may effectively suppress undesired image quality degradation (e.g., flicker) potentially caused the change in the frame rate.

Figure 8:
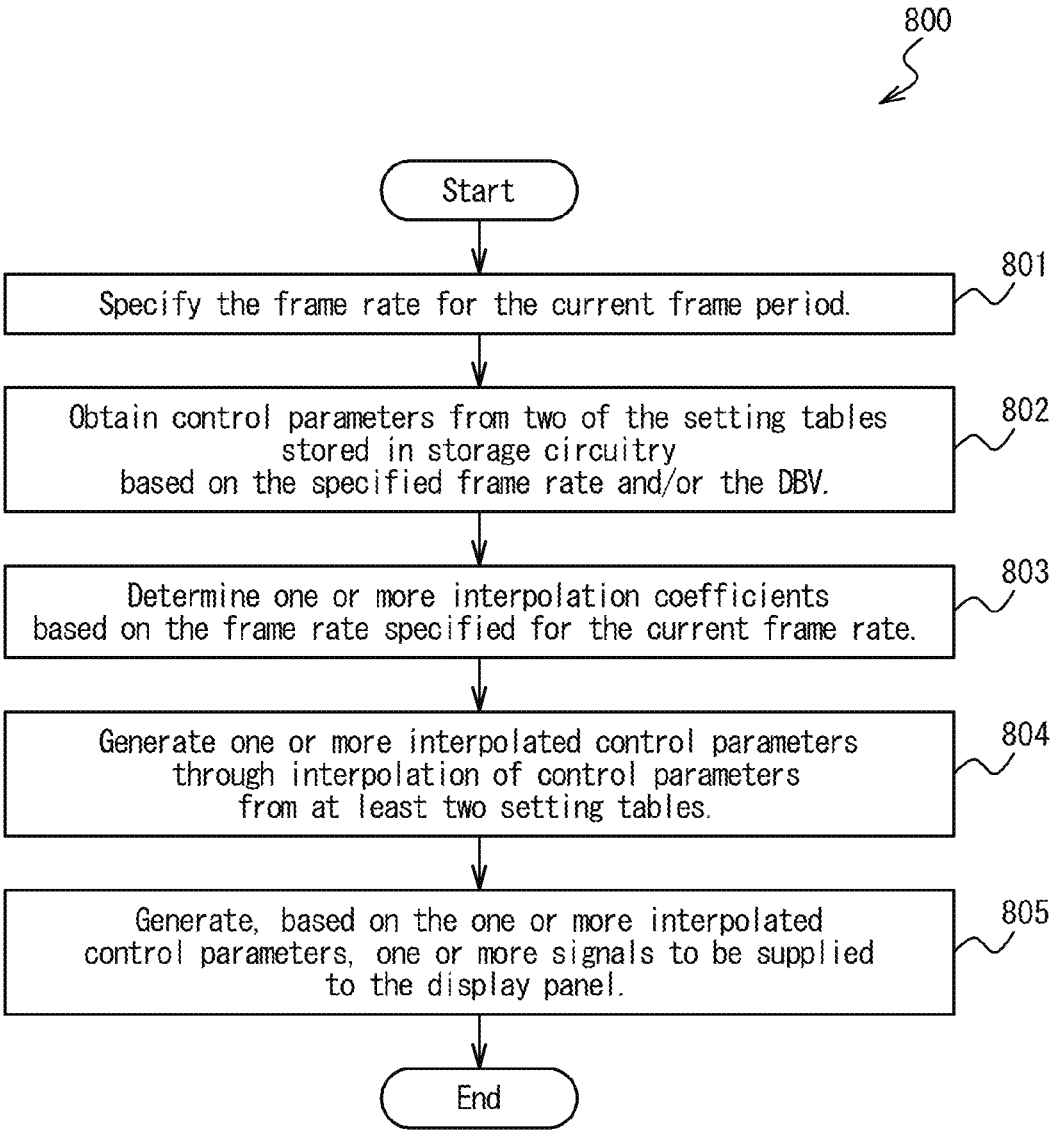
FIG. 8 illustrates an example method for controlling signal supply circuitry, according to one or more embodiments.

Method 800 of FIG. 8 illustrates steps for controlling the display panel 1 (as illustrated in FIG. 1) while the frame rate of the display device 100 is being adjusted from a first frame rate (e.g., 60 Hz) to a second frame rate (e.g., 90 Hz), according to one or more embodiments. It should be noted that the order of the steps may be altered from the order illustrated.

At step 801, the frame rate for the current frame period is specified by the host 200 or the timing controller 21. At step 802, control parameters (e.g., gamma parameters, top voltage command values, bottom voltage command values, and emission control commands) are obtained from two of the setting tables 25 stored in the storage circuitry 22 based on the specified frame rate and/or the DBV. In one implementation, the two setting tables 25 may be selected based on the frame rate specified for the current frame period, and one subtable is selected based on the DBV from each of the selected two setting tables 25. In one implementation, subtable #i is selected from each of the selected two setting tables 25 when the DBV is in the DBV range #i. In such embodiments, the controller parameters may be selected from each subtable #i of the selected two setting tables 25. In embodiments where the storage circuitry 22 stores only two setting tables 25, the controller parameters may be obtained from each subtable #i of the two setting tables 25.

At step 803, one or more interpolation coefficients are determined based on the frame rate specified for the current frame rate. At step 804, one or more interpolated parameters to be supplied to the signal supply circuitry 13 are generated by interpolating the corresponding control parameters obtained from the two selected setting tables 25 (e.g., from subtables #i of the two selected setting tables 25) based on the interpolation coefficients. The one or more interpolated parameters thus generated may include a set of gamma parameters Para_Gamma, a top voltage command value Vtop*, a bottom voltage command value Vbottom*, and/or an emission command value Emission*. At step 805, one or more signals to be supplied to the display panel 1 (e.g., the gamma voltages to be supplied to the pixel circuits 5 and the emission control signal ESTV) are generated by the signal supply circuitry 13 based on the interpolated control parameters supplied to the signal supply circuitry 13.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

control circuitry configured to:

store a first setting table for a first frame rate and a second setting table for a second frame rate;

in response to adjusting a frame rate of a display device from the first frame rate to the second frame rate, generate an interpolated control parameter through interpolation of a first control parameter obtained from the first setting table and a second control parameter obtained from the second setting table;

set the frame rate of the display device to the first frame rate during a first frame period;

set the frame rate of the display device to the second frame rate during a second frame period after the first frame period; and set the frame rate of the display device to a third frame rate between the first frame rate and the second frame rate during a third frame period between the first frame period and the second frame period; and signal supply circuitry configured to generate at least one first signal to be supplied to a display panel based on the interpolated control parameter.

2. The display driver of claim 1, wherein the control circuitry is configured to:

select the first setting table and the second setting table from among a plurality of setting tables based on a specified frame rate.

3. The display driver of claim 2, wherein the specified frame rate is specified by a host that is external to the display driver.

4. The display driver of claim 1, wherein the control circuitry is configured to:

select the first control parameter from the first setting table based on a display brightness value (DBV); and select the second control parameter from the second setting table based on the DBV.

5. A display driver, comprising:

control circuitry configured to:

store a first setting table for a first frame rate and a second setting table for a second frame rate;

in response to adjusting a frame rate of a display device from the first frame rate to the second frame rate, generate an interpolated control parameter through interpolation of a first control parameter obtained from the first setting table and a second control parameter obtained from the second setting table; and signal supply circuitry configured to generate at least one first signal to be supplied to a display panel based on the interpolated control parameter, wherein at least one first signal comprises a gamma voltage supplied to a pixel circuit of the display panel, wherein the signal supply circuitry comprises:

image processing circuitry configured to generate output voltage data that specifies a voltage level of the gamma voltage based on the interpolated control parameter and input image data defined for the pixel circuit; and driver circuitry configured to generate the gamma voltage based on the output voltage data.

6. The display driver of claim 5, wherein the first control parameter comprises a first gamma parameter used to define a first gamma curve for the first frame rate, wherein the second control parameter comprises a second gamma parameter used to define a second gamma curve for the second frame rate.

7. The display driver of claim 6, wherein the interpolated control parameter comprises a third gamma parameter used to define a third gamma curve used to generate the gamma voltage.

8. The display driver of claim 5, wherein the control circuitry is configured to:

select a first gamma parameter from the first setting table based on a DBV; and select a second gamma parameter from the second setting table based on the DBV.

9. The display driver of claim 5, wherein the control circuitry is configured to:

set the frame rate of the display device to the first frame rate during a first frame period;

set the frame rate of the display device to the second frame rate during a second frame period after the first frame period; and set the frame rate of the display device to a third frame rate between the first frame rate and the second frame rate during a third frame period between the first frame period and the second frame period, wherein the interpolation of the first control parameter and the second control parameter comprises interpolation of a first gamma parameter and a second gamma parameter during the third frame period based on the third frame rate.

10. The display driver of claim 5, wherein the signal supply circuitry further comprises: grayscale voltage supply circuitry configured to supply a plurality of grayscale voltages to the driver circuitry, wherein the first control parameter specifies a first voltage level of a highest one of the plurality of grayscale voltages for the first frame rate, wherein the second control parameter specifies a second voltage level of the highest one of the plurality of grayscale voltages for the second frame rate, and wherein the interpolated control parameter specifies the highest one of the plurality of grayscale voltages for a specified frame rate between the first frame rate and the second frame rate.

11. The display driver of claim 5, wherein the signal supply circuitry further comprises: grayscale voltage supply circuitry configured to supply a plurality of grayscale voltages to the driver circuitry, wherein the first control parameter specifies a first voltage level of a lowest one of the plurality of grayscale voltages for the first frame rate, wherein the second control parameter specifies a second voltage level of the lowest one of the plurality of grayscale voltages for the second frame rate, and wherein the interpolated control parameter specifies the lowest one of the plurality of grayscale voltages for a specified frame rate between the first frame rate and the second frame rate.

12. A display driver, comprising:

control circuitry configured to:

store a first setting table for a first frame rate and a second setting table for a second frame rate;

in response to adjusting a frame rate of a display device from the first frame rate to the second frame rate, generate an interpolated control parameter through interpolation of a first control parameter obtained from the first setting table and a second control parameter obtained from the second setting table; and signal supply circuitry configured to generate at least one first signal to be supplied to a display panel based on the interpolated control parameter, wherein the at least one first signal comprises an emission control signal that controls a ratio of a number of pixel circuits that emit light to a total number of pixel circuits of the display panel.

13. The display driver of claim 12, wherein the first control parameter comprises a first emission command value that controls a first ratio of a number of pixel circuits that emit light to the total number of the pixel circuits of the display panel for the first frame rate, and wherein the second control parameter comprises a second emission command value that controls a second ratio of a number of pixel circuits that emit light to the total number of the pixel circuits of the display panel for the second frame rate.

14. The display driver of claim 13, wherein the interpolated control parameter comprises a third emission command value generated through interpolation of the first emission command value and the second emission command value, the emission control signal being generated based on the third emission command value.

15. A display device, comprising:

a display panel; and a display driver comprising:

control circuitry configured to:

store a first setting table for a first frame rate and a second setting table for a second frame rate; and in response to adjusting a frame rate of a display device from the first frame rate to the second frame rate, generate an interpolated control parameter through interpolation of a first control parameter obtained from the first setting table and a second control parameter obtained from the second setting table; and signal supply circuitry configured to generate at least one first signal to be supplied to a display panel based on the interpolated control parameter, wherein at least one first signal comprises a gamma voltage to be supplied to a pixel circuit of the display panel, wherein the signal supply circuitry comprises:

image processing circuitry configured to generate output voltage data that specifies a voltage level of the gamma voltage based on the interpolated control parameter and input image data defined for the pixel circuit; and driver circuitry configured to generate the gamma voltage based on the output voltage data.

16. The display device of claim 15, wherein the first control parameter defines a first gamma curve for the first frame rate, wherein the second control parameter defines a second gamma curve for the second frame rate, and wherein the interpolated control parameter defines a third gamma curve used to generate the gamma voltage.

17. A method, comprising:

in response to adjusting a frame rate of a display device from a first frame rate to a second frame rate, determining an interpolated control parameter through interpolation of a first control parameter obtained from a first setting table for the first frame rate and a second control parameter obtained from a second setting table for the second frame rate, wherein the first control parameter comprises a first gamma parameter used to define a first gamma curve for the first frame rate, wherein the second control parameter comprises a second gamma parameter used to define a second gamma curve for the second frame rate; and generating at least one first signal to be supplied to a display panel based on the interpolated control parameter.

* * * * *